US006203753B1

(12) United States Patent
Donaldson

(10) Patent No.: US 6,203,753 B1
(45) Date of Patent: Mar. 20, 2001

(54) METHOD FOR PREPARING HIGH PERFORMANCE FERROUS MATERIALS

(75) Inventor: Ian W. Donaldson, Jefferson, MA (US)

(73) Assignee: The Presmet Corporation, Worcester, MA (US)

( * ) Notice: Subject to any disclaimer, the term of this patent is extended or adjusted under 35 U.S.C. 154(b) by 0 days.

(21) Appl. No.: 08/854,963

(22) Filed: May 13, 1997

Related U.S. Application Data

(60) Provisional application No. 60/017,317, filed on May 13, 1996.

(51) Int. Cl.[7] ..... B22F 3/16
(52) U.S. Cl. ..... 419/54; 419/55
(58) Field of Search ..... 419/53, 54, 55

(56) References Cited

U.S. PATENT DOCUMENTS 4,955,798 9/1990 Musella et al. .
5,154,881 * 10/1992 Rutz et al. ..... 419/37

FOREIGN PATENT DOCUMENTS 163161 3/1949 (AT) .

OTHER PUBLICATIONS

Jones, W.D. "Fundamental Principles of Powder Metallurgy", Edward Arnold Publishers, Ltd. 1960, pp. 844–848.*

* cited by examiner

*Primary Examiner*—Daniel J. Jenkins
(74) *Attorney, Agent, or Firm*—Darby & Darby

(57) ABSTRACT

The present invention provides a method for making metal parts from metal powder compositions comprising an iron base metal powder and an amide lubricant. The method comprises the steps of compacting said composition, pre-sintering the compacted composition, compacting the compacted and pre-sintered composition, and sintering the recompacted composition. The metal parts have improved physical and mechanical properties.

24 Claims, 6 Drawing Sheets

METHOD FOR PREPARING HIGH PERFORMANCE FERROUS MATERIALS

This application claims priority pursuant to 35 U.S.C. §119 from U.S. Provisional Application Ser. No. 60/017,317 filed May 13, 1996, the entire disclosure of which is hereby incorporated by reference.

FIELD OF THE INVENTION

The present invention relates to methods of making metal parts from metal powder compositions comprising an iron base metal powder and an amide lubricant. The sintered metal parts have improved physical and mechanical properties.

BACKGROUND OF THE INVENTION

Metal parts can be prepared using powdered metallurgy (P/M) from powdered metal compositions by methods known within the industry. These parts can be formed in shapes which would be difficult to form by other methods. Many applications for parts formed from P/M processes require high strength and dynamic properties. It is necessary to re-engineer or increase the density of the composition to meet the requirements. However, the methods available for obtaining high density, high strength parts by P/M processes such as high temperature sintering, double-press and double-sintering processes, and liquid phase sintering have been found to have inherent limitations.

Recently, U.S. Pat. No. 5,154,881 disclosed a composition which provided a single compaction method for obtaining high density parts. This patent utilizes an iron-based metal powder composition containing an amide lubricant. The lubricant is a reaction product of a monocarboxylic acid, a dicarboxylic acid, and a diamine. The composition, metal and lubricant, is compacted in the die of the temperature of up to about 690° F., and preferably in a range of 300–500° F., at a pressure of about 35–60 tons per square inch (tsi). Further disclosed is the fact that the composition can be warm-pressed at a temperature of about 300° F. However, the properties achieved using the materials and method described in this patent are not sufficient to meet the needs of all applications.

Therefore, a need exists to develop a process for preparing parts which have improved impact strength and tensile properties. Parts which have these properties would be expected to have longer life and be less subject to wear.

SUMMARY OF THE INVENTION

The present invention provides a method for making a sintered part from a metal powder composition comprising an iron-based metal powder and an amide lubricant. The method comprises the steps of compacting the metal powder composition, pre-sintering the compacted composition, recompacting the compacted and pre-sintered composition, and sintering the recompacted composition. The invention also contemplates parts having improved properties prepared by the method of the invention.

The method of the subject invention is useful with any iron-based powder composition using an amide lubricant. The iron-based powder refers to any iron-containing particles generally used in the practice of powder metallurgy including, but not limited to, particles of substantially pure iron; particles of iron in admixture with, for example, particles of alloying elements such as transition metals and/or other fortifying elements; and pre-alloyed iron particles.

The amount of lubricant to be used can be up to about 15 weight percent of the composition, based on the total weight of metal powder and lubricant. A preferred embodiment contains from about 0.1 to about 10 weight percent lubricant. Because the lubricants of this invention are reaction-product mixtures, they melt over a temperature range that can encompass a wide range. Depending on the particular lubricant used, melting will commence at a temperature between about 300° F. and 500° F., and the lubricant mixture will be completely melted at some temperature up to 500° F. above this initial melting point.

DETAILED DESCRIPTION OF THE INVENTION

Figure 1:
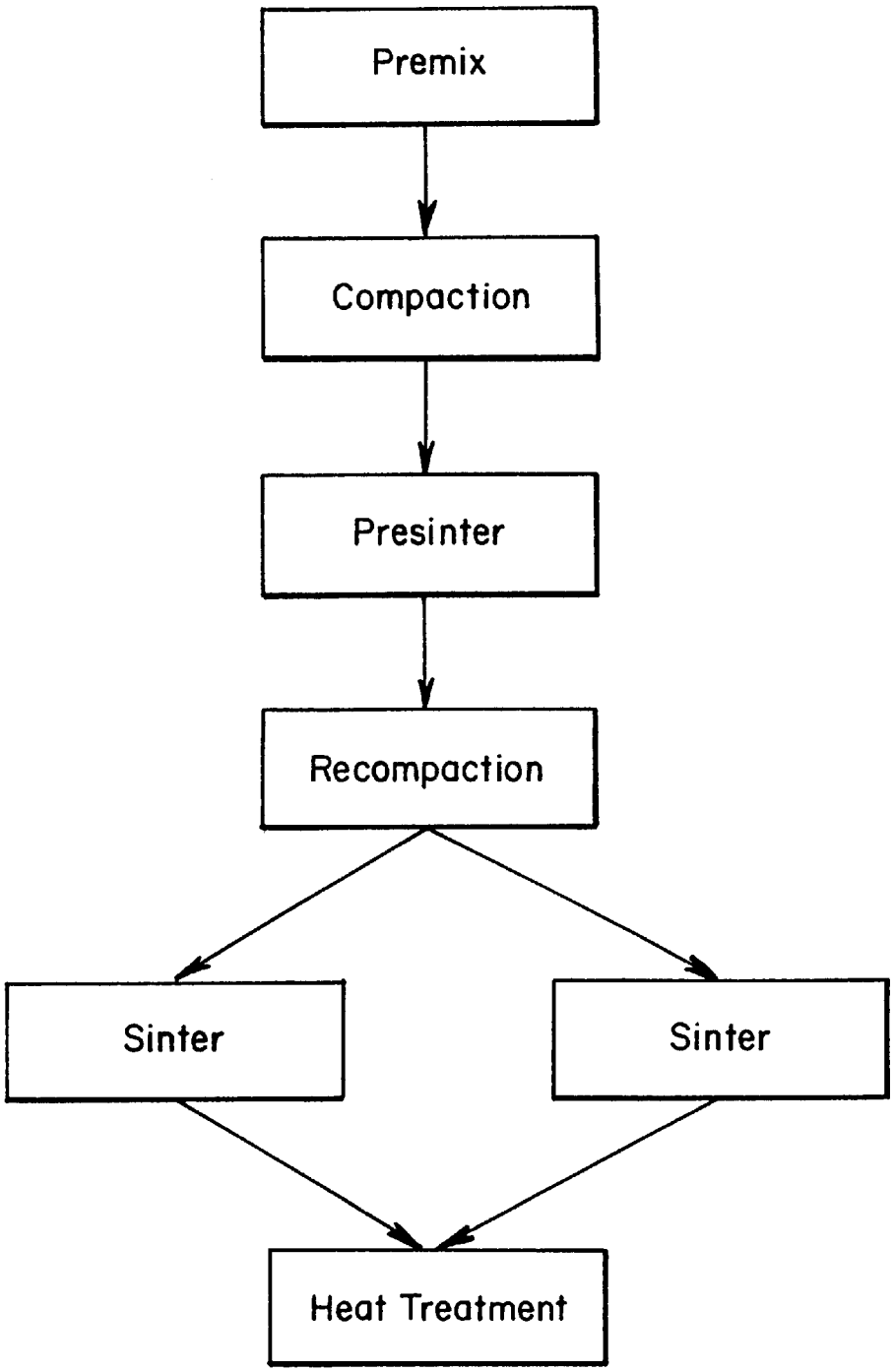
FIG. 1 is an flow chart illustration of the experimental procedures.

The subject invention provides a method for making a sintered metal part having improved physical and mechanical properties. The method of the present invention employs an amide lubricant admixed with an iron-based metal powder prior to compaction. The presence of the lubricant permits compaction of the powder composition at higher temperatures without significant die wear. The compacted composition is then pre-sintered. The pre-sintered part is then recompacted and sintered.

The improved physical properties include properties such as, density, thermal conductivity, electrical conductivity, and the like. The improved, mechanical properties include properties such as, impact strength, transverse rupture strength (TRS), fatigue strength, tensile properties such as, ultimate tensile strength, elongation, and yield strength.

The density of parts made by the method of the invention is greater than 7.4 g/cm$^3$. Preferably the density is from about 7.4 g/cm$^3$ to about 7.7 g/cm$^3$.

The elongation of sintered metal parts can be from about 1.5% to about 5% for carburized parts. Preferably elongation for carburized parts is from about 2% to about 4%. For sinter hardened parts elongation will be from about 2% to about 8%, and preferably from about 4% to about 7%. The ultimate tensile strength (UTS) for carburized parts will be from 150,000 to about 230,000 (psi). Preferably carburized parts have a UTS of from about 160,000 to about 190,000 psi. The UTS for sinter hardened parts is from about 180,000 to about 240,000 psi. Preferably the UTS for sinter hardened parts is from about 200,000 to 230,000 psi.

The impact strength for carburized parts is from about 20 to about 50 ft-lbf. Preferably the impact strength is from about 35 to about 45 ft-lbf. The impact strength of sinter hardened parts is from about 30 to about 75 ft-lbf and preferably from about 45 to about 70 ft-lbf.

The transverse rupture strength (TRS) for carburized parts is from about 260,000 to about 380,000 psi. Preferably the carburized parts have a TRS of from about 320,000 to about 360,000 psi. Sinter hardened parts will have a TRS of from about 250,000 to about 380,000 psi, and preferably from about 280,000 to about 310,000 psi.

Heat treatment is performed by standard methods know in the art. For example, carburizing heat treatment is conducted in an integral quench furnace in an endothermic atmosphere (typically CO) at temperatures from about 1500° F. to about 1700° F. and preferably at a temperature of about 1500° F. to about 1600° F. After carburizing, the parts are oil quenched.

Alternatively, after sintering, heat treatment can be accomplished by cooling the parts at a rate of about 80 degrees per minute to about 400 degrees per minute from a temperature of about 1600° F. to about 400° F. The preferred rate of cooling is from about 100 degrees per minute to about 200 degrees per minute.

Heat treatment is typically followed by tempering. Tempering is normally conducted at a temperature of 300° F. to about 500° F. and preferably from at 350° F. to about 400° F.

The metal powder compositions useful in practicing the present invention contain iron-based particles of the kind generally used in powder metallurgical methods. Examples of "iron-based" particles, as used herein, includes but is not limited to particles of substantially pure iron; particles of iron pre-alloyed with other elements (for example, steel-producing elements) that enhance the strength, hardenability, electromagnetic properties, or other desirable properties of the final product; and particles of iron in admixture with particles of such alloying elements.

Substantially pure iron powders useful in practicing the invention are powders of iron containing not more than about 1.0% by weight, preferably no more than about 0.5% by weight, of normal impurities. Examples of such highly compressible, metallurgical-grade iron powders are the Ancorsteel® 1000 series of pure iron powders available from Hoeganaes Corporation, Riverton, N.J.

The iron-based powder can incorporate one or more alloying elements that enhance the mechanical or other properties of the final metal part. Such iron-based powders can be in the form of an admixture of powders of pure iron and powders of the alloying elements or, in a preferred embodiment, can be powders of iron that has been pre-alloyed with one or more such elements. The admixture of iron powder and alloying-element powder is prepared using known mechanical mixing techniques. The pre-alloyed powders can be prepared by making a melt of iron and the desired alloying elements, and then atomizing the melt, whereby the atomized droplets form the powder upon solidification.

Examples of alloying elements that can be incorporated into the iron-based powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. The preferred alloying elements are nickel, copper, molybdenum, and graphite. Pre-alloyed iron powders that incorporate such alloying elements are available from Hoeganaes Corp. as part of its Ancorsteel® line of powders. Premixes of pure iron powders with alloying-element powders are also available from Hoeganaes Corp. as Ancorbond® powders.

Typically, the iron-based powder comprises alloying elements in the range of from about 6% to about 20% by weight based on the total amount of powder. Preferably, the alloying elements in the powder comprise from about 8% to 14% by weight. In a preferred powder, nickel will comprise from about 4% to about 12% by weight of the powder. Most preferably, the level of nickel will be from 6% to 10%.

A preferred iron-based powder is Distaloy 4800A, a 4% Ni: 1.5% Cu: 0.5% Mo diffusion alloyed iron powder, available from Hoeganaes Co., Riverton, N.J. Another example of a useful powder is iron, pre-alloyed with molybdenum (Mo), produced by atomizing a melt of substantially pure iron containing from about 0.5 to about 2.5 weight percent Mo. An example of such a powder is Hoeganaes Ancorsteel® 85HP steel powder, which contains 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes Ancorsteel® 4600V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493 entitled "Steel Powder Admixture Having Distinct Pre-alloyed Powder of Iron Alloys". This steel powder composition is an admixture of two different pre-alloyed iron-based powders, one being a pre-alloy of iron with 0.5–2.5 weight percent molybdenum, num, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition.

The particles of iron or pre-alloyed iron can have a weight average particle size as small as one micron or below, or up to about 850–1,000 microns, but generally the particles will have a weight average particle size in the range of about 10–500 microns. Preferred are iron or pre-alloyed iron particles having a maximum average particle size up to about 350 microns. With respect to those iron-based powders that are admixtures of iron particles with particles of alloying elements, it will be recognized that particles of the alloying elements themselves are generally of finer size than the particles of iron with which they are admixed. The alloying-element particles generally have a weight average particle size below about 100 microns, preferably below about 75 microns, and more preferably in the range of about 5–20 microns.

Examples of the types of parts which can be prepared include but are not limited to parts such as, for example, gerotors and gerolors for hydraulic motors; parts for high pressure pumps; automotive parts for steering wheel tilt mechanisms such as, for example, levers, pawls, or shoes; gears for transmissions, either automotive or non-automotive, and the like.

The metal powder compositions that are the subject of the present invention contain an amide lubricant formed from the condensation of a mixture comprising a dicarboxylic acid, a monocarboxylic acid, and a diamine. The dicarboxylic acid is a linear acid having the general formula HOOC (R)COOH where R is a saturated or unsaturated linear aliphatic chain having from about 4 to about 10, preferably from about 6 to about 8, carbon atoms.

Preferably, the dicarboxylic acid is an 8 to 10 carbon saturated acid. Sebacic acid is a preferred dicarboxylic acid. The dicarboxylic acid is present in an amount of from about 10 to about 30 weight percent of the starting reactant materials.

The monocarboxylic acid is a saturated or unsaturated fatty acid having from about 10 to about 20 carbon atoms. Preferably, the monocarboxylic acid is a saturated acid having from 12 to 20 carbon atoms. Stearic acid is a preferred saturated monocarboxylic acid. A preferred unsaturated monocarboxylic acid is oleic acid. The monocarboxylic acid is present in an amount of from about 10 to about 30 weight percent of the starting reactant materials.

The diamine is an alkylene diamine, preferably of the general formula $(CH_2)_x(NH_2)_2$ where x is an integer from about 2 to about 6. Ethylene diamine is a preferred diamine. The diamine is present in an amount of from about 40 to about 80 weight percent of the starting reactant materials to form the amide product.

The condensation reaction is preferably conducted at a temperature of from about 500–530° F. and at a pressure up to about 7 atmospheres. The reaction is preferably conducted in a liquid state. Under reaction conditions at which the diamine is in a liquid state, the reaction can be performed in an excess of the diamine, acting as a reactive solvent. When the reaction is conducted at the preferred elevated temperatures as described above, even the higher molecular weight diamines will generally be in liquid state. A solvent such as toluene, or p-xylene can be incorporated into the reaction mixture, but the solvent must be removed after the reaction is completed. This can be accomplished by distillation or simple vacuum removal. The reaction is preferably conducted under an inert atmosphere such as nitrogen and in the presence of a catalyst, such as, for example, 0.1 weight percent methyl acetate and 0.001 weight percent zinc powder. The reaction is allowed to proceed to completion, usually not longer than about 6 hours.

The lubricants formed by the condensation reaction are a mixture of amides characterized as having a melting range rather than a melting point. As those skilled in the art will recognize, the reaction product is generally a mixture of moieties whose molecular weights, and therefore properties dependent on such, will vary. The reaction product can generally be characterized as a mixture of diamides, monoamides, bisamides, and polyamides. The preferred amide product has at least about 50%, more preferably at least about 65%, and most preferably at least about 75%, by weight diamide compounds. The preferred amide product mixture contains primarily saturated diamides having from 6 to 10 carbon atoms and a corresponding weight average molecular weight range of from 144 to 200. A preferred diamide product is N,N'-bis{2-[(1-oxooctadecyl)amino] ethyl} diamide.

The reaction product, containing a mixture of amide moieties, is well suited as a warm-pressing metallurgical lubricant. The presence of monoamides allows the lubricant to act as a liquid lubricant at the pressing conditions, while the diamide and higher melting species act as both liquid and solid lubricants at these conditions.

Generally, the amide lubricant begins to melt at a temperature between about 300° F. and 500° F., preferably about 400° F. to about 500° F. The amide generally will be fully melted at a temperature about 500° F. above this initial melting temperature, although it is preferred that the amide reaction product melt over a range of no more than about 200° F.

The preferred amide product mixture has an acid value of from about 2.5 to about 5; a total amine value of from about 5 to 15, a density of about 1.02 at 25° C., a flash point of about 545° F., and is insoluble in water.

A preferred lubricant is commercially available as ADVAWAX® 450 amide sold by Morton International of Cincinnati, Ohio, an ethylene bis-stearamide having an initial melting point between about 390° F. and 570° F.

The amide lubricant is generally added to the composition in the form of solid particles. The particle size of the lubricant can vary, but is preferably below about 100 microns. Most preferably the lubricant particles have a weight average particle size of about 5–50 microns. The lubricant is admixed with the iron-based powder in an amount up to about 15% by weight of the total composition. Preferably the amount of lubricant is from about 0.1 to about 10 weight percent, more preferably about 0.1–1.0 weight percent, and most preferably about 0.2–0.8 weight percent, of the composition. The iron-based metal particles and lubricant particles are admixed together, preferably in dry form, by conventional mixing techniques to form a substantially homogeneous particle blend.

The metal powder composition containing the iron-based metal powders and particles of amide lubricant, as above described, is compacted in a die, under conditions known in the art, i.e., chill-pressing (pressing below ambient temperatures), cold-pressing (pressing at ambient temperatures), hot-pressing (pressing at temperatures above those at which the metal powder is capable of retaining work-hardening), and warm-pressing (pressing at temperatures between cold-pressing and hot-pressing). The preferred temperature range for pressing are "warm" temperatures. The compacted part is then removed from the die and pre-sintered, according to standard metallurgical techniques. The pre-sintering step is typically employed to remove lubricants and anneal the work hardened part. Generally, pre-sintering requires heating a part to a temperature significantly below the final sintering temperature. The pre-sintering temperatures are usually from about 60% to 75% of the final sintering temperature.

The compacted parts are pre-sintered at a temperature of about 1350° F. to about 1580° F. The pre-sintered part is then lubricated with an external lubricant, recompacted and sintered at a temperature of about 2000° F. to about 2500° F. Preferably sintering is conducted at a temperature of about 2200° F. to about 2400° F.

Typically, for recompaction, an external lubricant is used on the part to minimize die wear and allow for proper release of the part from the die after pressing. This lubricant can be applied by methods well known in the art such as dipping (immersion), tumbling or spraying. Examples of lubricants include, but are not limited to, water based lubricants such as, for example, drawing compound 2070-93-02 (Houghton International, Valley Forge, Pa.); dry lubricants such as, for example, Molykote Z (Nalco Chemical Co., Naperville, Ill.); oil based lubricants such as Multisize 9559B (Blachford Corporation, Frankfort, Ill.); or Accu-lube (ITW Fluid Products, Norcross, Ga.).

Sintering is conducted at a temperature of from about 2000° F. to about 2500° F. in a nitrogen based atmosphere having from about 5% to about 75% hydrogen, by volume. However, it has been found that improved properties can be achieved by sintering at a temperature greater than 2200° F. and preferably at about 2300° F. in a $N^2$ atmosphere having up to about 75% hydrogen, by volume.

The metal powder composition is compacted at a pressing temperature, measured as the temperature of the composition as it is being compacted, of up to about 700° F. Preferably the compacting is conducted at a temperature above 212° F., more preferably at a temperature of from about 285° F. to about 350° F. Typical compaction (pressing) pressures are about 3–100 tons per square inch (tsi), and preferably about 35–60 tsi. The presence of the lubricant in the metal powder composition enables warm compaction of the composition to be conducted practically and economically. The lubricant reduces the stripping and sliding pressures generated at the die wall during ejection of the compacted component from the die, reducing scoring of the die wall and prolonging the life of the die. Following compaction, the part is pre-sintered, at temperatures and other conditions appropriate to the composition of the iron-based powder. The part is then recompacted, at either ambient or "warm" temperatures and sintered under the conditions described above.

The invention will now be illustrated by examples. These examples are meant to illustrate the invention without limitation.

EXAMPLES

Materials

For the initial evaluation, test premixes were prepared from Distaloy 4800A, a 4% Ni-1.5% Cu-0.5% Mo diffusion alloyed iron powder, as the base material to produce two different compositions by addition of elemental Ni and graphite. The base materials were supplied by The Hoeganaese Co. The iron-based powdered material of the present invention used a 0.6% by weight loading of Advawax®, an ethylene bis stearamide. The conventional iron-based powdered material used Acrawax at a level of 0.75 wt. %. The compositions are described in Table 1.

Compositions 1 and comparative Composition 1 were chosen for their high mechanical properties when a carburizing heat treatment is used to achieve the properties.

TABLE 1

Composition of the processed powders.

| Material | Base Material (Wt. %) | | | Elemental Additions (Wt. %) | | |
|---|---|---|---|---|---|---|
| Designation | Ni | Cu | Mo | Ni | Graphite | Lubricant |
| Powder 1 | 4 | 1.5 | 0.5 | 2.0 | 0.3 | 0.6 |
| Conventional Powder 1 | 4 | 1.5 | 0.5 | 2.0 | 0.3 | 0.75 |

TABLE 1-continued

Composition of the processed powders.

| Material | Base Material (Wt. %) | | | Elemental Additions (Wt. %) | | |
|---|---|---|---|---|---|---|
| Designation | Ni | Cu | Mo | Ni | Graphite | Lubricant |
| Powder 2 | 4 | 1.5 | 0.5 | 4.0 | 0.8 | 0.6 |
| Conventional Powder 2 | 4 | 1.5 | 0.5 | 4.0 | 0.8 | 0.75 |

Testing

Test specimens, between 5–10, were evaluated for each test condition. The test specimens were processed and evaluated according to industry standard test as described in "*Standard Test Methods for Metal Powders and Powder Metallurgy Products*", Metal Powder Industries Federation, Princeton, N.J., (1994) or ASTM B528 for sintered and heat treated TRS, ASTM 23 for heat treated unnotched Charpy impact, and sintered and heat treated tensile properties. Tensile properties were determined on flat, machined or unmachined tensile bars prepared as described in the Metal Powdered Industries Standard 10 for preparing and evaluating test specimens for powdered metallurgy materials (also described in ASTM E8) with a 1" gage length.

The sample bars prepared were about 1.25 inches in length, about 0.5 inches in width, and about 0.25 inches in height; 0.394 inches by 0.394 inches and 2.165 inches in length; and tensile bars having a 1 inch gage length prepared as described in ASTM E8.

TRS and tensile testing was performed at a crosshead speed of 0.1 in./min (2.5 mm/min). A Rockwell Hardness Tester was used for apparent hardness measurements in either the Rockwell C scale or Rockwell B scale. FIG. 1 shows the experimental procedure flow chart.

Double-Press, Double Sinter (DPDS) Properties

It was found that when using the the method of the invention densities and mechanical properties could be increased beyond what could be attained by conventional double-press, double-sinter (DPDS) methods. Powdered materials having the compositions of powder 1 and powder 2 were used as the basis for developing the relationship for mechanical properties. These materials have been developed to provide a good combination of wear, strength and impact properties when processed through conventional DPDS techniques to a 7.35 g/cm$^3$ density and carburized. Evaluation was performed for two different carburizing heat treatments for both single and double-pressed processing at two different sintering temperatures with a comparison to the conventional method properties. The different carburizing cycles were used to assess the effect of austenitizing temperature.

Processing

Example 1

The preparation and processing of test specimens was performed on conventional equipment. The dies and tool members were modified to maintain the temperature within range of +/−5° F. Before compacting, the dies and tool members were allowed to reach a constant temperature.

The iron-powder/amide lubricated powders of the invention, powder 1 was compacted at 300° F. at a pressure of 45 tsi. Conventional powder 1 was compacted at ambient temperature at a pressure of 45 tsi. After compacting the parts were then pre-sintered at 1500° F. in a nitrogen based atmosphere with 10% hydrogen gas.

The pre-sintered parts were immersed in a purified vegetable oil lubricant and recompacted at 45 tsi, at ambient temperatures. Sintering was then performed at 2050° F. in a nitrogen atmosphere having 75% hydrogen.

The carburizing heat treatment was performed in an integral quench furnace. Two cycles were employed, the first, cycle A, was preferably at 1500° F. for 1 hour with an endothermic atmosphere providing a 0.7% carbon potential. The parts were oil quenched and tempered at 375° F. for 1.5 hours.

The second carburizing heat treatment, cycle B, was performed at 1600° F. with an endothermic atmosphere at a 0.8% carbon potential for 1.5 hours. The parts were oil quenched and tempered at 300° F. for 1.5 hours.

The density was determined. Then the parts were then tested for TRS, impact energy and tensile properties.

Example 2

The procedure of example 1 for compaction, pre-sintering and recompaction was followed. The parts were then sintering at 2300° F. for 30 minutes in a nitrogen atmosphere having 75% hydrogen. Heat treatment at either 1500° F. or 1600° F. and the corresponding tempering steps were conducted as described in Example 1.

Example 3

The procedure of Example 1 for compaction, pre-sintering and recompaction is followed using powder 2 and comparative powder 2. The presintered parts are then sintered at 2050° F. in a nitrogen atmosphere with hydrogen added. Heat treatment at 1500° F. or 1600° F. and the corresponding tempering steps are conducted as described in Example 1.

Example 4

The procedure of Example 1 for compaction, pre-sintering and recompaction is followed using powder 2 and comparative powder 2. The presintered parts are then sintered at 2300° F. in a nitrogen atmosphere with hydrogen added. Heat treatment at 1500° F. or 1600° F. and the corresponding tempering steps are conducted as described in Example 1.

Results

An increase of approximately 0.1 g/cm$^3$ in sintered density was realized through the second compaction step, following the method of the invention over the standard single press method. Increasing the sintering temperature from 2050° F. to 2300° F. provided an additional increase in density of approximately 0.05 g/cm$^3$. The improved density for the double pressed (recompacted) samples provided an increase in TRS and impact energy values over the single pressed results. For parts prepared by sintering at 2050° F. and carburizing cycle A, an increase of 12.5% in TRS and 49.4% in impact energy was observed. Parts prepared by sintering at 2300° F. and carburizing cycle A had TRS and impact energy increased 13.3% and 81.3%, respectively.

For parts prepared by sintering at 2050° F. and using carburizing cycle B, an increase of 13.2% in TRS and 31.2% in impact energy was observed. Parts prepared by sintering at 2300° F. and carburizing cycle B had an increase of 8.7% in TRS and 106.7% in impact energy.

The impact energy of the double pressed (DP) samples sintered at 2300° F. averaged 41.7 ft-lbf for parts prepared using carburizing cycle A and 39.5 ft-lbf for parts prepared using carburizing cycle B. Some improvements in TRS were seen with an increase in austenitizing temperature, while impact energy was improved slightly with the lower austenitizing temperature. The results are illustrated in FIGS. 2 through 5.

Figure 2:
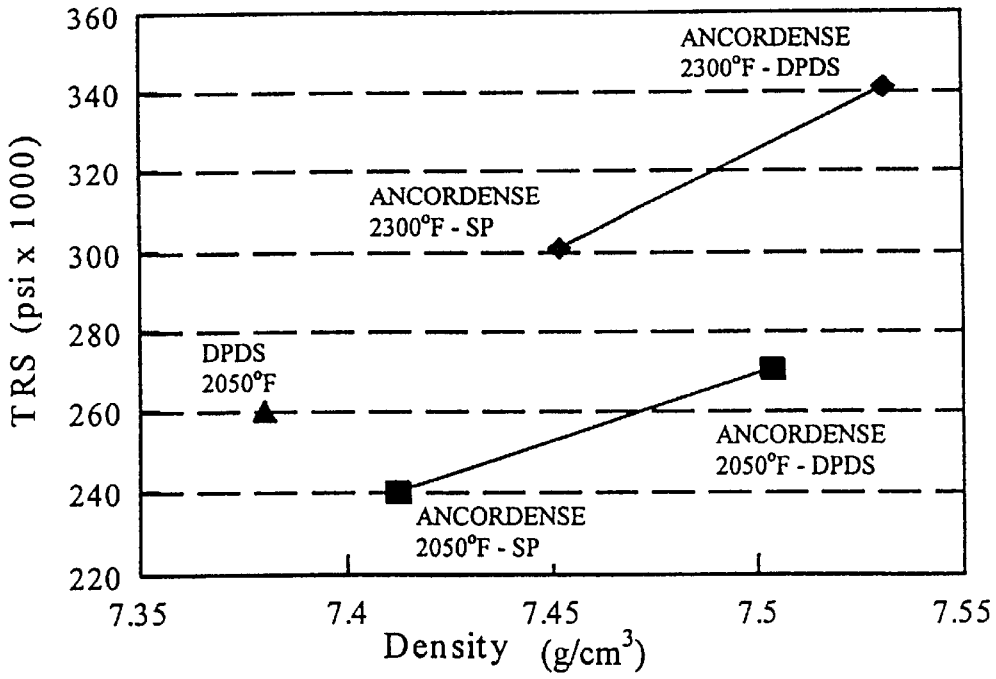
FIG. 2 is a graphic illustration of the increase in transverse rupture strength (TRS) for parts prepared using carburizing cycle A for heat treatment.

FIG. 2 illustrates the increase in transverse rupture strength (TRS) for parts prepared using carburizing cycle A, for heat treatment, at 1500° F., as a function of density. It can be seen that the double press double sinter (DPDS) process provides a substantial increase in TRS over parts formed by the single press (SP) method.

Figure 3:
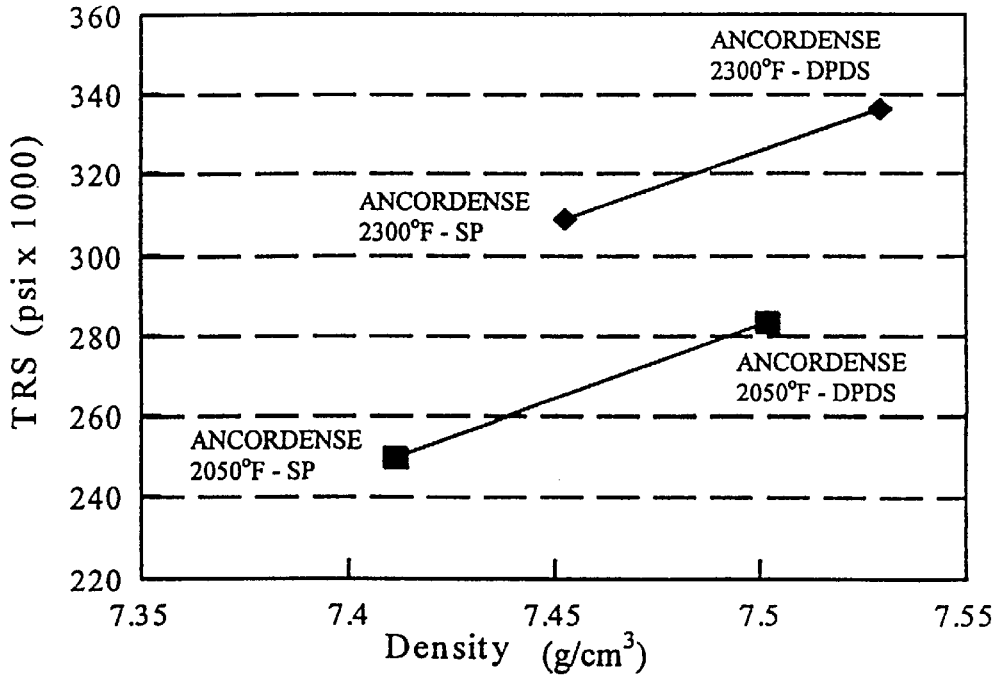
FIG. 3 is a graphic illustration of the increase in TRS for parts prepared using carburizing cycle B for heat treatment.

FIG. 3 illustrates the increase in TRS for parts prepared using carburizing cycle B, for heat treatment, at 1600° F., as a function of density. Again, it can be seen that the DPDS method provides a substantial increase in TRS.

Figure 4:
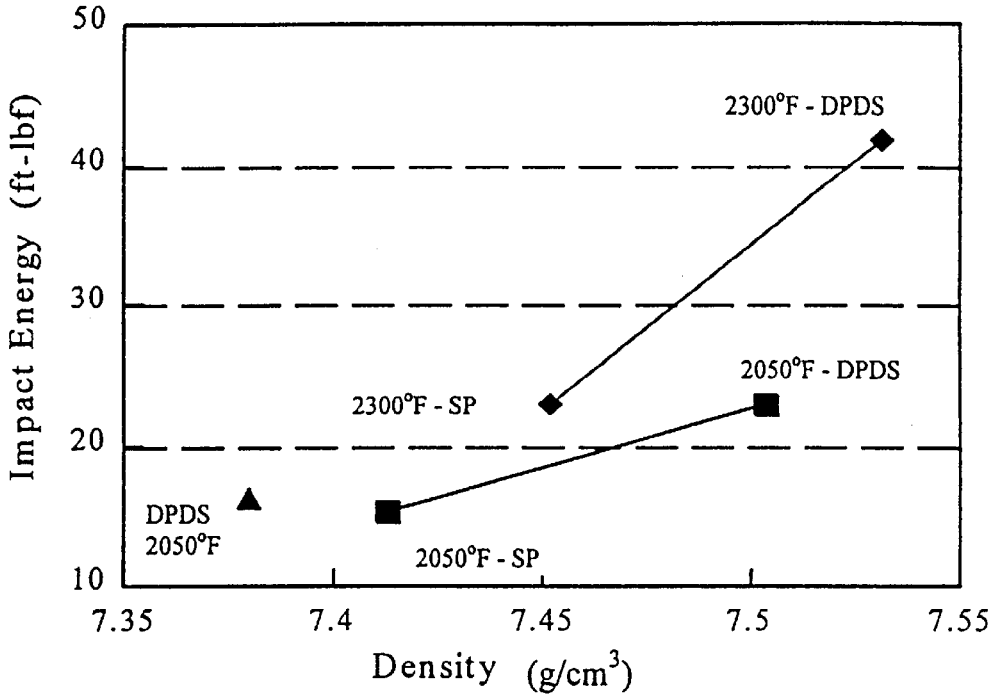
FIG. 4 is a graphic illustration of the increase in impact energy for parts prepared using carburizing cycle A for heat treatment.

FIG. 4 illustrates the increase in impact energy for parts prepared using carburizing cycle A, for heat treatment, at 1500° F., as a function of density. It can be seen that the DPDS process provides a substantial increase in impact strength over parts formed by the SP method.

Figure 5:
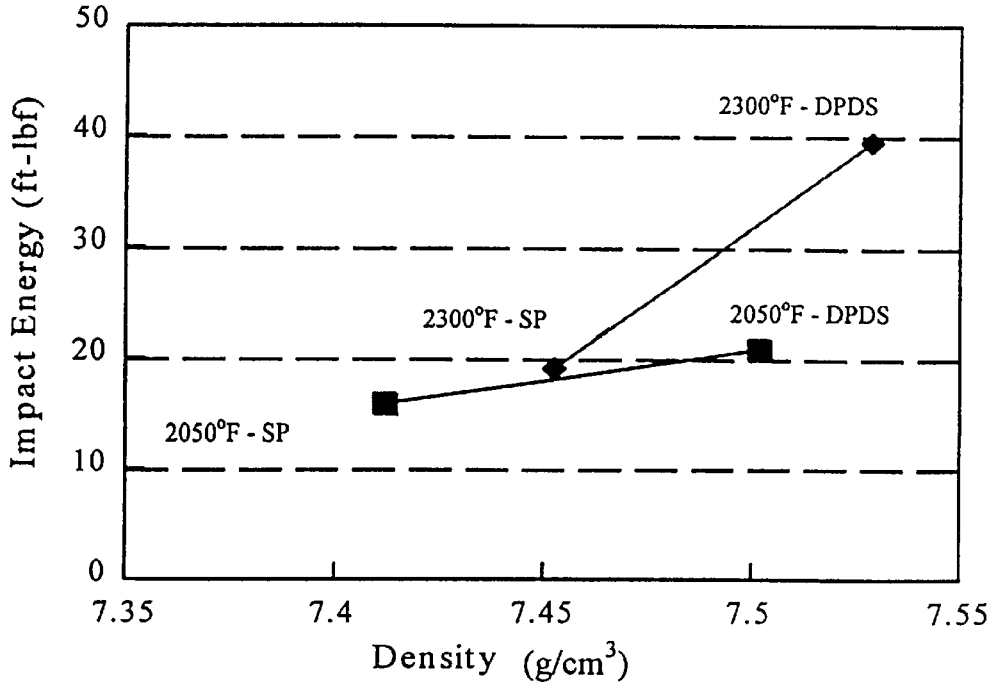
FIG. 5 is a graphic illustration of the increase in impact energy for parts prepared using carburizing cycle B for heat treatment.

FIG. 5 illustrates the increase in impact energy for parts prepared using carburizing cycle B, for heat treatment, at 1600° F., as a function of density. It can be seen that the DPDS method provides a substantial increase in impact energy.

For parts prepared by sintering at 2050° F. and carburized using cycle A, the apparent hardness was found to average between 31 and 32.5 on the Rockwell Hardness Scale (HRC). The parts sintered at 2300° F. and carburized using cycle A had an apparent hardness of between 35.5 and 33.5 HRC. This compared to an average of 36 HRC for conventional DPDS.

The parts prepared by sintering at 2050° F. and carburized using cycle B had an increase in the apparent hardness averaging between 39.5 and 40.5 HRC. Parts prepared by sintering at 2300° F. and carburizing using cycle B had an apparent hardness between 41.5 and 37 HRC.

Metallography

Sections for metallographic examination were cut from TRS test pieces unless otherwise noted. Optical metallography was performed on a Nikon Epiphot. All scanning electron microscopy (SEM) was performed on a JEOL JSM-840 with Kevex system for energy dispersive X-ray analysis.

Figure 6:
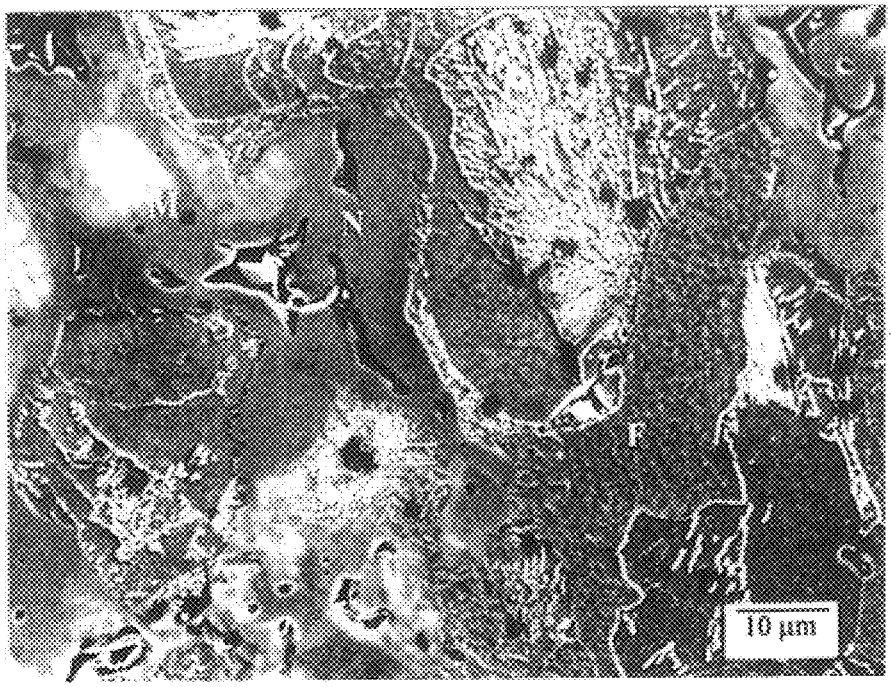
FIG. 6 is a scanning electron microscopy (SEM) photograph of the microstructure of an uncarburized sample sintered at 2050° F.

Analysis of the sintered parts by SEM revealed a microstructure consisting of pearlite, ferrite, martensite, bainite and nickel-rich regions. The high nickel regions were prevalent around porosity indicating that the nickel diffusion was predominantly surface diffusion as shown in FIG. 6 for the 2050° F. sintered samples. Nickel diffusion along grain boundaries and smoothing or rounding of the pores was also apparent. For parts sintered at 2300° F., pore rounding and the degree of diffusion was more pronounced.

A substantial volume of ferrite was observed throughout the microstructure. Pearlite was found in regions of very low alloy content and in some higher alloy areas as evidenced by the morphology and spacing of the lamellar $Fe_3C$ platelets. The low alloy regions formed colonies of pearlite in alternating and relatively parallel strips (plates) of $Fe_3C$ and proeutectoid ferrite. The higher alloy regions exhibited divorced, randomly oriented $Fe_3C$ platelets in a ferrite matrix. This pearlite was in the vicinity of the nickel rich areas in the core of the particles. This showed the influence of local concentration of alloy elements in solid solution in the austenite on the nucleation and growth of the pearlite.

Cross sections of the carburized samples revealed microstructures consisting of tempered, high carbon martensite and nickel-rich regions in the case with a gradual transformation to mixed martensite, bainite, pearlite, ferrite and nickel-rich regions in the core. The composition gradients were verified by EDS, showing little change from the sintered state. Fracture analysis of the tensile and TRS bars was performed, with the core and case regions compared.

Figure 7:
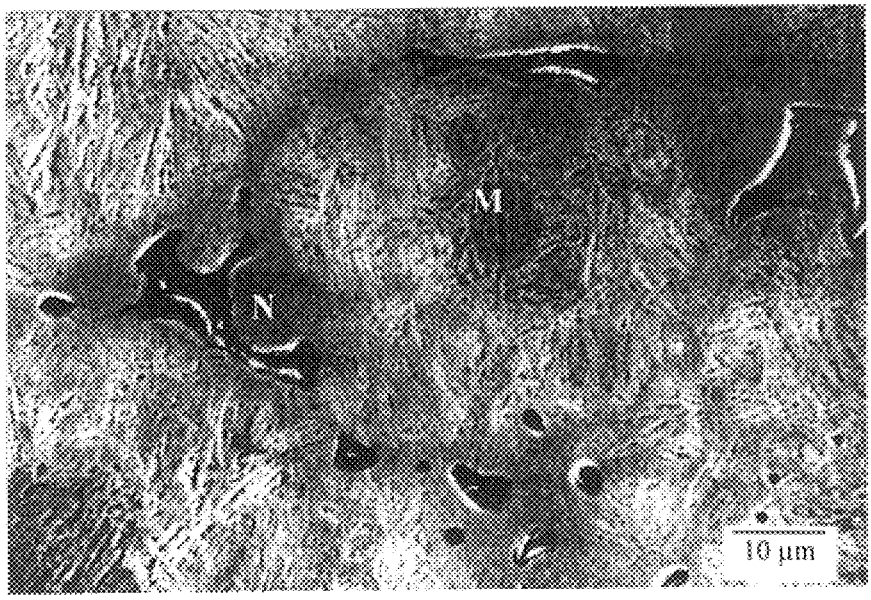
FIG. 7 is a SEM photograph of the microstructure of a carburized sample sintered at 2050° F.
Figure 8:
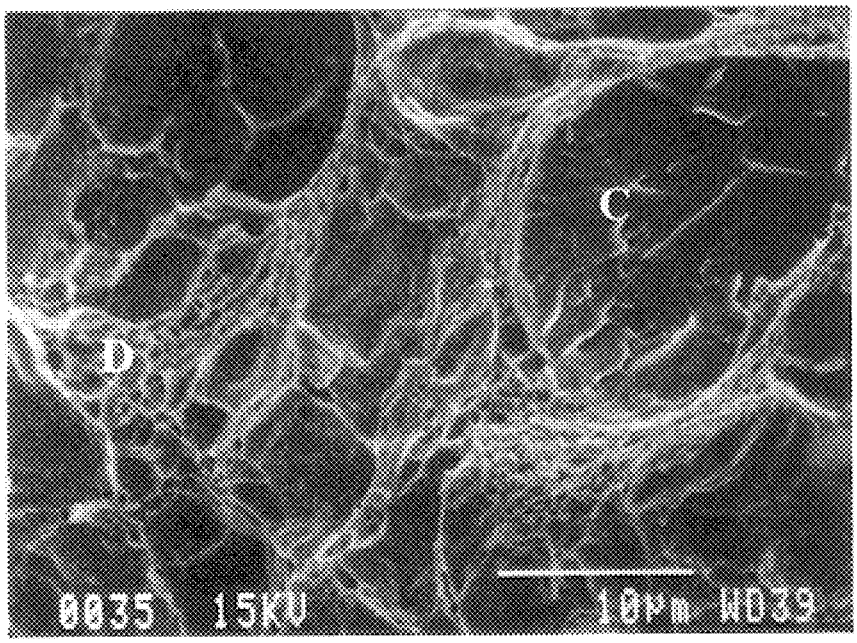
FIG. 8 is a SEM photographs illustrating the shear fracture surfaces from a single pressed sample bar sintered at 2050° F., after carburizing cycle B.
Figure 9:
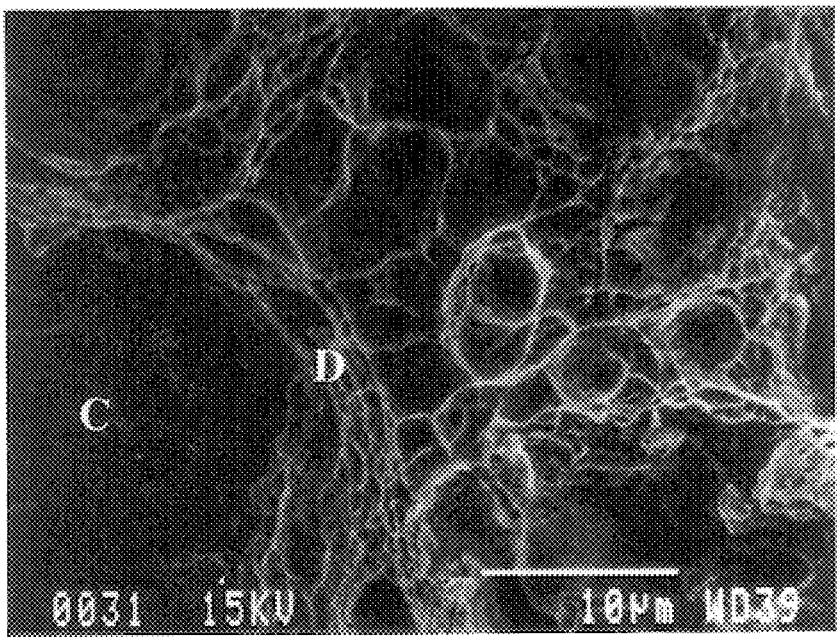
FIG. 9 is a SEM photographs illustrating the shear fracture surfaces from a single pressed sample bar sintered at 2300° F., after carburizing cycle B.
Figure 10:
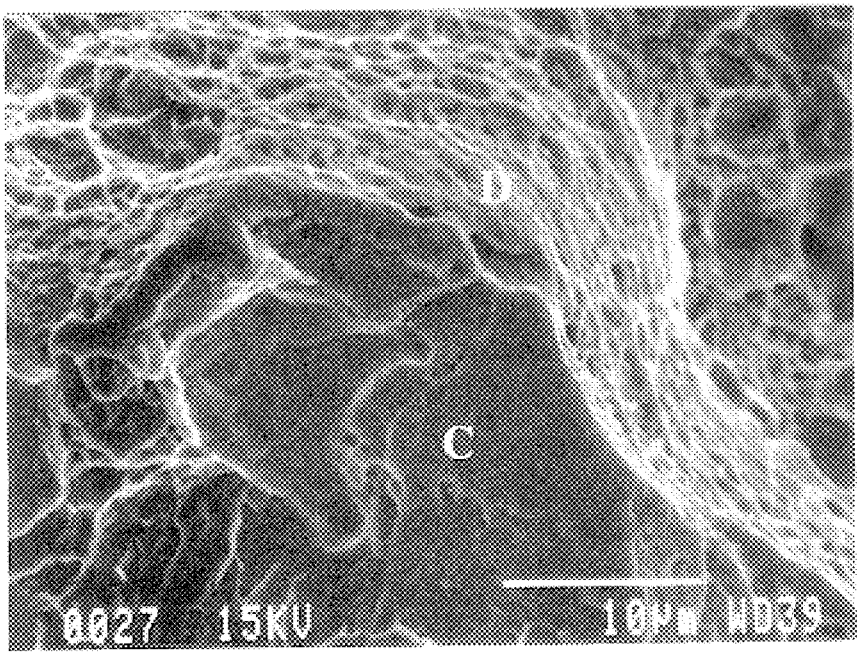
FIG. 10 is a SEM photographs illustrating the shear fracture surfaces from a double pressed sample bar sintered at 2050° F., after carburizing cycle B.
Figure 11:
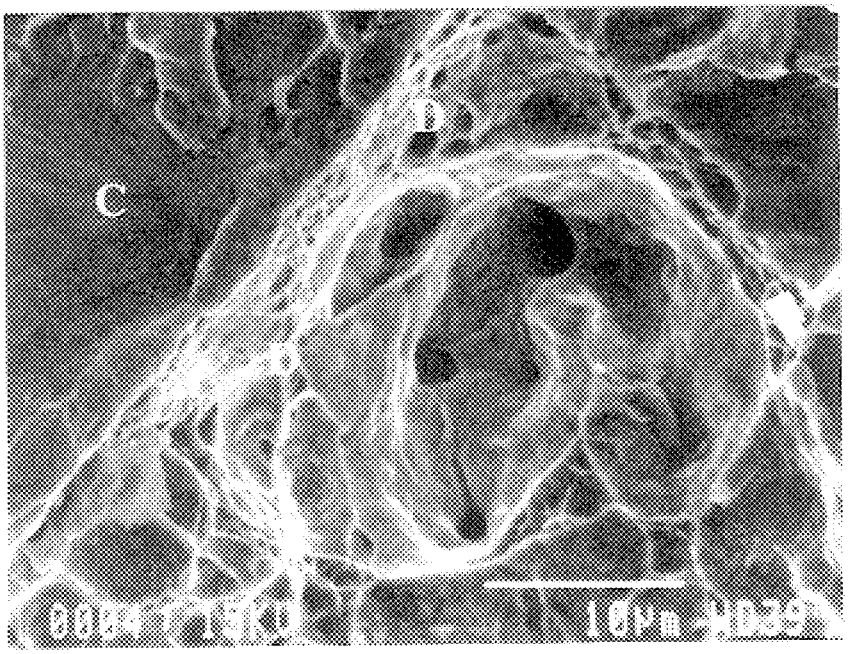
FIG. 11 is a SEM photographs illustrating the shear fracture surfaces from a double pressed sample bar sintered at 2300° F., after carburizing cycle B.

FIG. 7 shows a case region in the SP 2050° F. sintered bar.

SEM analysis of the TRS fracture surfaces revealed mixed mode (both transgranular and ductile rupture) fracture in the case region and only ductile rupture in the core for all samples. The DP samples exhibited a greater amount of transgranular fracture in the case with the 2300° F. sintered parts having the highest level. In addition, both DP samples had larger ruptured bond area fractions than the SP samples. The ductile rupture regions in the case areas, which were at prior particle bonds, indicate that the surface diffusion of nickel provided toughening and ductility to the interparticle bonds. The significant increase in bond area fraction for the double pressed parts provided the improvement seen in mechanical properties. FIGS. 8, 9, 10 and 11 show the shear fracture surfaces from the TRS bars for the 1600° F. carburizing heat treatment.

The invention has been described above by reference to preferred embodiments but, as those skilled in the art will appreciate, many additions, omissions and modifications are possible all within the scope of the claims below.

All patents, literature references and test methods cited in this specification are hereby incorporated by reference in their entirety. In case of inconsistencies, the present description, including the definitions and interpretations, will prevail.

What is claimed is:

1. A method of making a sintered metal part from a metal powder composition comprising an iron-based metal powder and an amide lubricant, the metal powder composition containing carbon in an amount from 0.3 to 0.8 weight percent, the method comprising the steps of:

(a) compacting the composition at a temperature within the range of from 212° to 350° F.;

(b) pre-sintering the compacted composition at a temperature within the range of from 1350° to 1580° F.;

(b) lubricating the pre-sintered part with a lubricant;

(c) recompacting the compacted and pre-sintered composition; and (d) sintering the recompacted composition at a temperature of 2000° to 2400° F. in a $N_2$ atmosphere incorporating up to about 75% hydrogen by volume.

2. The method according to claim 1, wherein the recompacted, sintered part produced in step (e) has an ultimate tensile strength greater than 150,000 psi.

3. The method according to claim 1, wherein the recompacted, sintered part produced in step (e) has an impact energy of greater than 20 ft-lbf.

4. The method according to claim 1, wherein the recompacted, sintered part produced in step (e) has a traverse rupture strength of greater than 250,000 psi.

5. The method according to claim 1, wherein said iron based metal powder comprises at least one alloying element selected from the group consisting of molybdenum, manganese, magnesium, chromium, silicon, copper, nickel, gold, chromium, vanadium, columbium, carbon, graphite, phosphorus, and aluminum.

6. The method according to claim 5, wherein the iron based powder comprises pre-alloyed iron.

7. The method according to claim 6, wherein the pre-alloyed iron based powder is an atomized powder of iron containing dissolved molybdenum in an amount of from about 0.5–2.5 weight percent as an alloying element.

8. The method according to claim 6, wherein the iron-based powder is an admixture of two powders of pre-alloyed iron, the first powder containing about 0.5 to about 3 weight percent molybdenum and the second powder containing at least 0.15 weight percent carbon and at least about 25 weight percent of a transition element selected from the group consisting of chromium, manganese, vanadium, columbium, and combinations thereof.

9. The method according to claim 6, wherein the pre-alloyed iron-based powder comprises iron that has been pre-alloyed with about 0.5–0.6 weight percent molybdenum, from about 1.5–2.0 weight percent nickel, and from about 0.1–0.25 weight percent manganese.

10. The method according to claim 1, wherein said amide is present in an amount up to about 15% by weight of said composition.

11. The method according to claim 1, wherein said amide is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is from 2 to about 6.

12. The method according to claim 11, wherein the monocarboxylic acid is stearic acid.

13. The method according to claim 11, wherein the dicarboxylic acid is sebacic acid.

14. The method according to claim 11, wherein the diamine is ethylene diamine.

15. The method according to claim 11, wherein the monocarboxylic acid is stearic acid, the dicarboxylic acid is sebacic acid and the diamine is ethylene diamine; and wherein the amide lubricant has a melting point range that is greater than at least about 300° F.

16. The method according to claim 10, wherein the lubricant is present in an amount of from 0.1 to about 1 weight percent.

17. The method according to claim 10, wherein the amide lubricant comprises at least 65 percent by weight diamides.

18. The method according to claim 5, wherein the metal powder has 4% by weight of nickel.

19. The method according to claim 1, wherein the pre-sintering step in step (b) is conducted at a temperature from about 60% to about 75% of the final sintering temperature in step (e).

20. The method according to claim 1, wherein the sintering step in step (e) is conducted at a temperature of about 2200° to about 2400° F.

21. The method according to claim 1, wherein the sintering step in step (e) is conducted at a temperature of about 2200° to about 2300° F.

22. The method according to claim 1, wherein the compacting step in step (a) is conducted at a temperature of from about 285° to about 350° F.

23. The method according to claim 1, wherein the compacting step in step (a) is conducted at a pressure of from about 3 to about 100 tsi.

24. The method according to claim 1, wherein the compacting step in step (a) is conducted at a pressure of from about 35 to about 60 tsi.

* * * * *